US006883193B2

(12) United States Patent
Brooks et al.

(10) Patent No.: US 6,883,193 B2
(45) Date of Patent: Apr. 26, 2005

(54) ELASTIC FITTED COVER

(75) Inventors: Lynwood Charles Brooks, Richmond, VA (US); Erik William Spencer, Cjesterfield, VA (US); Stephen Horace Tsiarkezos, Elkton, MD (US)

(73) Assignee: Xymid, L.L.C., Chesterfield, VA (US)

( * ) Notice: Subject to any disclaimer, the term of this patent is extended or adjusted under 35 U.S.C. 154(b) by 0 days.

(21) Appl. No.: 10/382,263

(22) Filed: Mar. 5, 2003

(65) Prior Publication Data

US 2004/0172754 A1 Sep. 9, 2004

(51) Int. Cl.[7] ..... A47G 9/00; D03D 15/00

(52) U.S. Cl. ..... 5/497; 442/182; 112/413; 28/156

(58) Field of Search ..... 5/497, 498, 499, 5/500, 502; 442/182; 112/413; 28/156

(56) References Cited

U.S. PATENT DOCUMENTS

| | | | | | |
|---|---|---|---|---|---|
| 2,528,313 | A | * | 10/1950 | Kessler | 5/497 |
| 2,942,280 | A | * | 6/1960 | May | 5/497 |
| 3,290,702 | A | * | 12/1966 | Seltzer | 5/497 |
| 3,789,441 | A | * | 2/1974 | Weiss | 5/497 |
| 4,801,482 | A | * | 1/1989 | Goggans et al. | 428/68 |
| 4,879,169 | A | | 11/1989 | Zafiroglu | |
| 4,962,546 | A | * | 10/1990 | Vitale | 5/497 |
| 4,998,421 | A | | 3/1991 | Zafiroglu | |
| 5,127,115 | A | * | 7/1992 | Williams et al. | 5/497 |
| 5,187,952 | A | | 2/1993 | Zafiroglu | |
| 5,603,132 | A | * | 2/1997 | Zafiroglu | 5/497 |
| 5,603,701 | A | | 2/1997 | Fischer | |
| 5,636,393 | A | | 6/1997 | Zafiroglu et al. | |
| 6,199,231 | B1 | * | 3/2001 | Zafiroglu | 5/497 |
| 6,272,701 | B1 | | 8/2001 | Zafiroglu | |
| 2002/0011612 | A1 | * | 2/2002 | Curro et al. | 442/381 |
| 2002/0112287 | A1 | * | 8/2002 | Thomas et al. | 5/503.1 |
| 2003/0122411 | A1 | * | 7/2003 | Chambers et al. | 297/228.13 |
| 2003/0192124 | A1 | * | 10/2003 | Setzer | 5/655.7 |

* cited by examiner

*Primary Examiner*—Sunil Singh
(74) *Attorney, Agent, or Firm*—Jeffrey C. Lew; Lawrence Isakoff

(57) ABSTRACT

A form-fitting cover has a top panel that has an elastic stretch in a least one linear direction in the range of 25 to 150% and a skirt attached to and depending from the periphery of the top panel. The skirt has an upper edge that has an elastic stretch at least equal to the elastic stretch of the periphery of the top panel. The skirt further has of an elastic or inelastic stretch that is at least as large as the elastic stretch of the periphery of the top panel.

8 Claims, 1 Drawing Sheet

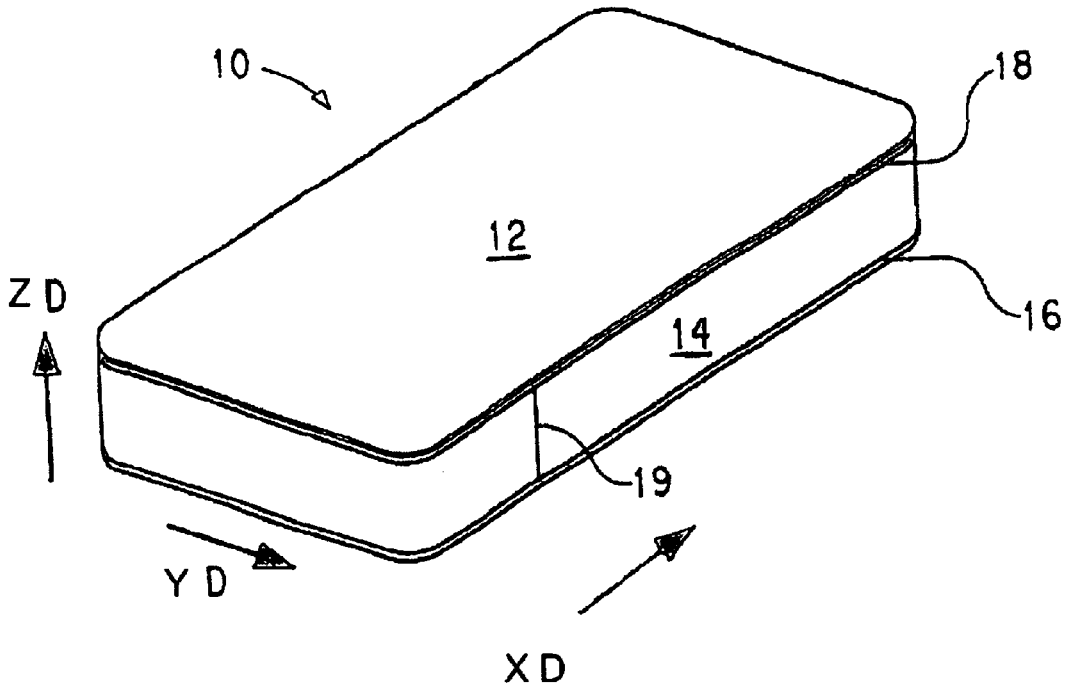
10
18
12
ZD
16
14
19
YD
XD

ELASTIC FITTED COVER

BACKGROUND OF THE INVENTION

1. Field of the Invention

This invention relates to a cover for various objects. The cover comprises a top panel for cushioning and overlaying the top of an object and a skirt for covering the sides of the object, the skirt being attached to and depending from the periphery of the top panel. More particularly, the invention concerns such a cover that has an elastic top panel and is suitable for covering objects having different cross-sectional dimensions and different heights. The cover of the invention is particularly useful as a form-fitting cover for mattresses of different dimensions 2. Description of the Prior Art Various common objects often are fitted with padded and/or protective covers. Among such objects are mattresses, seats, tables, toilet lids and the like. During moving and/or storage, various objects of furniture (e.g., chests, desks, tables) are covered with loosely draped protective quilts. Because such objects have a wide variety of dimensions, a large inventory of covers of different sizes is required.

Form-fitting covers typically are made of substantially inelastic and non-stretchable fabrics that are cut to specific dimensions intended to cover objects of corresponding dimensions. Covers capable of fitting mattresses of a given cross-sectional area and different thickness are known, for example, from U.S. Pat. Nos. 5,187,952, 5,5,603,132, 5,636,393 and 6,272,701, the entire disclosures of which are incorporated herein by reference. However, a fitted cover of different size is required for each mattress of different cross-sectional area.

An aim of the present invention is to provide a cover that can fit objects that differ in cross-sectional dimensions, as well as in thickness or height.

Though not related to fitted covers, U.S. Pat. Nos. 4,879,169 and 4,998,421, the entire disclosures of which are incorporated herein by reference, respectively describe an elastic quilted composite fabric and an elastic stitchbonded fabric. The quilted fabric of U.S. Pat. No. 4,879,169 has at least one gathered fibrous layer and at least one elastic fabric layer. The layers of the composite fabric are quilted together and then the elastic characteristics of the fabric are activated. The elastic fabric of U.S. Pat. No. 4,998,421 is formed by overfeeding a fibrous web to a stitchbonding machine, stitching the web with elastic thread having high residual stretch and then removing the resultant stitchbonded fabric from the machine under low tension. As will be shown hereinafter, such fabrics can be used in part of the covers of the present invention.

SUMMARY OF THE INVENTION

The present invention provides an improved form-fitting cover of the type that comprises a top panel for cushioning and covering the top surface of an object and a skirt attached to and depending from the top panel for covering the sides of the object. In accordance with the improvement of the invention, the top panel has an elastic stretch in at least one linear direction in the range of 25 to 150%, preferably at least 30%, most preferably at least 50%. Preferably, the top panel is an elastic quilted composite fabric. The skirt is an elastic or inelastic stretchable fabric. The skirt has an elastic upper edge that is attached to the periphery of the top panel.

The upper edge of the skirt has an elastic stretch that is at least as great as the elastic stretch of the top panel. Typically, the skirt has an elastic lower edge that pulls a portion of the skirt against the sides, or underneath the bottom, of the object being covered. The main portion of the stretchable skirt fabric (i.e., the portion between the upper and lower edges of the skirt) can stretch at least as much as the elastic top panel.

The invention also provides a method for producing an elastic cover for objects of different cross-sectional and height dimensions. The process comprises the steps of forming an elastic top panel, forming a stretchable skirt material and attaching the stretchable skirt material to the elastic top panel under conditions that provide substantially equal elastic stretch in the periphery of the top panel and the upper edge of the skirt.

BRIEF DESCRIPTION OF THE DRAWING

The invention will be better understood by reference to the drawing, which is an isometric view of a preferred cover of the invention. The drawing depicts a mattress cover 10 having an elastic top panel 12, and a skirt 14 attached to and depending from the top panel. The skirt has a lower edge 16, an upper edge 18 and a seam 19. In the drawing, XD signifies the direction parallel to the length of the object being covered, YD signifies the direction parallel to the width of the object being covered and ZD signifies the direction parallel to the height of the object being covered.

DETAILED DESCRIPTION OF PREFERRED EMBODIMENTS

Several terms, as used herein, have the following meanings. "Fiber" means staple fibers and/or continuous filaments. "Elastic" refers to the property of a fiber, filament, yarn or fabric, which allows it to stretch when under tension and then, when the tension is released, to retract quickly and forcibly to substantially its original dimension. "Latently elastic" describes the ability of certain fiber or fabric to become elastic when subjected to an activating treatment. "Stretch" is the characteristic of a fiber or fabric to elastically or inelastically elongate when under tension. "Spandex" is a manufactured elastic fiber manufactured from a long chain synthetic polymer comprised of at least 85% by weight of segmented polyurethane, which typically is capable of elastic stretch of at least 300%, often over 600%, and can exert significant retractive force when in a stretched condition. "Stretch yarn" is yarn made from filaments of thermoplastic polymer (e.g., nylon or polyester) which has been treated to make the yarn capable of significant stretch and rapid recovery. "Elastic combination yarn" is yarn that has at least two dissimilar yarn components, typically, one component being elastic yarn (e.g., spandex) and another component being conventional or textured yarn of natural or synthetic fiber. An "integral elastic edge" refers to the upper edge and/or lower edge of a skirt into which elastic yarns had been incorporated during manufacture of the skirt. "Stitchbonded" refers to the result of a conventional multi-needle stitching operation performed on a nonwoven fibrous substrate. Various stitch patterns which are employed in making the elastic pad and skirt fabric are identified with conventional warp-knitting nomenclature.

Preferred embodiments of the invention will now be described with reference to the drawing. The drawing shows a mattress cover 10 which comprises top panel 12 and skirt 14 attached to and depending from top panel 12.

Top panel 12 is the part of the cushioning cover 10 that provides padding for protecting the top of the object to be covered, which in the drawing is a mattress. Top panel 12 has an elastic stretch in at least one linear direction (i.e., XD and/or YD in the drawing) that typically is in the range of 15 to 150%. Preferably the elastic stretch of the top panel in at least one direction is at least 30%, most preferably at least 50%. For mattress covers, the desired elastic stretch of the top panel is at least 30% in the direction of the width (i.e., YD) of the mattress. Thus, a top panel can be produced that would be suitable for the top panel of a cover that can be used interchangeably for single- or double-bed mattresses or interchangeably for queen- or king-size mattress. Most preferably, the top panel has an elastic stretch in both the XD and YD. Such top panels with two-directional stretch are suitable for covers that are intended for fitting onto several sizes of cushions, tables, desks and the like.

A particularly preferred elastically stretchable top panel 12 is an elastic quilted composite fabric of the type described in U.S. Pat. No. 4,879,169. The elastic quilted composite fabric comprises at least two fibrous layers that are quilted together. One of the fibrous layers is buckled or gathered and has a substantial portion of the fibers in the layer not parallel to the plane of the quilted fabric. The gathered fibrous layer can be formed from a conventional carded web of natural and/or synthetic staple fibers, from any conventional "quilt-batting" material, or from various knitted, woven or non-woven fabric. In addition to the buckled fibrous layer, at least one layer of the quilted elastic composite fabric is an elastic layer. The elastic layer can be a woven, knitted or nonwoven fabric. A preferred elastic layer is a stitchbonded nonwoven fabric in which the stitch-bonding thread is an elastic thread (e.g., spandex) that amounts to between about ½ to 10% by weight of the elastic layer. A second elastic layer can be included in the top panel to form a "sandwich" of a buckled fibrous layer located between the two elastic fabric layers.

The preferred elastically stretchable top panel 12 described in the preceding paragraph can be prepared by the process method disclosed in U.S. Pat. No. 4,879,169. The process includes the steps of (1) providing a fibrous layer that contains latently elastic fibers amounting to between about ½ and 10% of the layer weight, (2) quilt-stitching the fibrous layer to a web of substantially nonbonded fibers to form a quilted composite and (3) with the quilted composite in a relaxed condition, activating the latently elastic fibers to provide the resultant quilted composite fabric with a stretchability of at least 25% in one direction. In the most preferred process for preparing the elastic top panel 12, the elastic fibers are of spandex whose elastic characteristics are activated by heating the quilted composite fabric to a temperature of at least 70° C. for a sufficient time to shrink the spandex and reduce fabric area by at least 25% while significantly increasing the thickness of the fabric. The resultant quilted composite fabric has an elastic stretch of at least 15% in at least one direction.

Another method for making elastically stretchable top panel 12 includes the steps of (1) providing an elastic fibrous layer, such as a stretch-knit fabric or an elastic stitchbonded fabric, (2) tensioning the elastic fibrous layer in at least one direction to extend its length in that direction by at least 25%, (3) while the elastic fibrous layer is so extended, quilt-stitching a web of substantially nonbonded fibers to the extended elastic fibrous layer to form a quilted composite fabric and (4) releasing the tension from quilted composite fabric. The quilted composite fabric of this process also has an elastic stretch of at least 15% in at least one direction.

Substantially any thread (e.g., conventional sewing thread) can be used for the quilt stitching the layers together. A wide variety of quilt-stitching patterns can be employed, such as the zig-zag, diamond, and other patterns described in U.S. Pat. No. 4,879,169, particularly at column 3, lines 8–20.

Instead of quilt-stitching thread, the buckled fibrous layer and the elastic layer or layers can be attached to each other by intermittent thermal, adhesive or ultrasonic bonds. The bonds form a pattern of intermittent connections in the layers similar to those formed by quilt-stitching.

Another method for making elastically stretchable top panel 12 comprises (1) providing a stretchable non-elastic fibrous layer, such as a fabric of hydraulically entangled polyester fibers, (2) providing a second stretchable non-elastic layer of substantially nonbonded fibers, such as cross-lapped batt of cotton fibers; and (3) quilt-stitching said layers together with elastic thread under low tension so that large amount of elastic stretch remains in the stitched thread, to form a quilted composite fabric. A spandex thread is particularly suitable for this fabrication. The resultant quilted composite fabric has an elastic stretch of at least 15% in at least one direction.

Another suitable material for elastic cushioning top panel 12 is prepared with a layer of polymeric foam (e.g., an elastic polyurethane foam) or sponge rubber located adjacent to an upper and/or lower elastic fabric layer (e.g., an elastic lightweight stitchbonded fabric). The layers are laminated with a thin layer of low-temperature melting film or intermittently attached to each other by quilt-stitching, adhesive bonding or thermal bonding.

Still another elastic fabric material suitable for top panel 12 is a stitchbonded fabric made in accordance with the general process of U.S. Pat. No. 4,998,421. The elastic fabric is formed by overfeeding a fibrous web to a stitch-bonding machine, stitching the web with elastic thread having high residual stretch and then removing the resultant stitchbonded fabric from the machine under low tension. Although this elastic fabric is suited for many of the top panels of covers of the invention, this elastic fabric usually is thinner and provides less cushioning for the top panels than the elastic fabrics prepared from the quilted materials described in the preceding paragraph.

Various stretchable fabrics are suitable for skirt 14 of the elastic fitted cover of the present invention. Suitable skirt materials are made from knitted, woven or nonwoven fabrics. The upper edge of the skirt is fabricated with elastic yams so that the stretch characteristics of the upper edge, when attached to the periphery of the top panel, match the stretch characteristics of the top panel. For example, skirt 14 can be knit with a conventional single-bar or multiple-bar warp-knitting machine, that is threaded with non-elastic yarns (e.g., bulked yams) along its entire knitting width, except at locations intended for edges 16 and 18, wherein elastic yams are employed. In a similar fashion, all yams used in a loom for weaving skirt fabric 14 are nonelastic, except for elastic yams that are used in warps intended for edges 16 and 18. Similar skirt fabrics can be prepared by known stitchbonding techniques. The elastic yams in the skirt edges help the skirt fit neatly around the sides and ends of the object being covered. Alternatively, instead of being integrally knit or woven into the skirt edges, the elastic yams can be incorporated in the skirt edges by gluing, stitching, thermal bonding, or the like.

The fabric employed to form the stretchable skirt of the fitted cover of the invention typically has a uniform, smooth surface. When non-elastic yams are used in the skirt fabric, except at the skirt edges, the skirt fabric typically can stretch at least 15% in one direction. The elastic yam incorporated into the lower elastic edge of the skirt fabric provides the lower edge with an elastic stretch at least 50% beyond its relaxed length. Preferably, the elastic stretch of the lower edge is in the range of 75 to 150%. Knitted skirts are preferred for use in the covers of the invention because of the ease and economy with which knitted skirts can be produced.

Stitchbonded elastic fabrics also are suitable for the skirts of covers of the invention. Such fabrics can have a wide range of elastic or inelastic stretch properties in the directions of the height and perimeter (i.e., perpendicular to the height direction) of the skirt. For example, U.S. Pat. Nos. 5,187,952 and 5,603,132 illustrate the fabrication of such stitchbonded fabrics employing spandex stitchbonding threads to form a fabric with lanes having elastic stretch of 20–280% in the transverse direction (i.e., in the height direction) and 80–400% in the longitudinal direction (i.e., in the direction of the skirt perimeter).

A process for making a form-fitting cover of the invention from the above-described top panels and skirts will now be described with reference to such covers intended for use on mattresses of different cross-sectional and height dimensions. The process comprises the steps of (1) preparing elastically stretchable top panel 12, (2) knitting, weaving or stitchbonding stretchable skirt fabric 14 with upper edge 18 and lower edge 16 each having elastic yams longitudinally extending and incorporated therein and (3) attaching upper edge 18 of the skirt to the periphery of top panel 12.

The manner in which the periphery of the top panel and the upper edge of the skirt are attached to each other depends on whether the elastic characteristics are already present in the top panel or are to be activated after the skirt is attached. In each case, the elastic properties of the upper elastic edge of the skirt and of top panel are arranged to match each other when the cover is completed, as will be explained in the following paragraphs.

When the top panel is already in its elastic condition, its length (XD) and width (YD) dimensions are predetermined by the minimum size of the object that is intended to be covered. The top panel is fabricated to have sufficient X) and YD elastic stretch to permit covering of the predetermined maximum size of object that is intended to be covered. In this case, the upper elastic edge of the skirt is attached to the periphery of the top panel with both the skirt upper edge and the top panel held in a "substantially non-tensioned" condition. Substantially non-tensioned means that the parts are held just taut enough to keep the parts flat while being attached to each other. To complete the cover, the ends of the skirt fabric are usually sewn together at seam 19, as indicated in the drawing.

When the top panel is in a latently elastic condition (i.e., its elasticity is to be activated later), the length (XD) and width (YD) dimensions of the top panel are predetermined by the maximum size of the object that is intended to be covered. The top panel is fabricated to have sufficient XD and YD elastic contraction (upon activation of its latent elasticity) to permit covering of the predetermined minimum size of the object that is intended to be covered. In this case, the upper elastic edge of the skirt is attached, to the periphery of the top panel with top panel held in a substantially non-tensioned condition but with the skirt upper edge under tension. The skirt upper elastic edge is tensioned sufficiently so that the edge can contract to substantially the same dimensions as those of the contracted top panel, when the elasticity of the top panel is subsequently activated. It is often convenient to attach the skirt to the panel periphery with the upper edge of the skirt fully extended. To complete the cover, prior to elasticity activation, the ends of the skirt fabric are usually sewn together at seam 19, as indicated in the drawing.

When the upper edge of the skirt is attached to the peripheral edge of the top panel, the peripheral length of the skirt fabric is equal to the peripheral length of the top panel. However, the amount of tension that is applied during the attachment is such that the main body of the skirt still can be stretched another 5 to 20% in the direction parallel to the edges of the skirt.

Test Methods

In the preceding description and in the Examples below, various fabrication parameters and certain stretch characteristics are given for the yams and the knitted or woven skirts of the fitted mattress cover of the invention. The methods used to determine these parameters and characteristics are described in this section.

Elastic and inelastic stretch recorded herein are measured on longitudinal strips and transverse strips of samples of skirt and top panel. Each strip measures 1-inch (2.5-cm) wide by 8-inches (20-cm) long, are cut from the skirt fabric. A standard length of 2.5 cm, parallel to the long edge of the strip, is marked near the middle of the strip. The strip is clamped at opposite ends of a 5-cm length of the strip, with the initially marked 2.5-cm length centrally located between the clamps. The strip is then subjected to tension by suspending a 10-pound (4.54 kg) weight from the lower clamp. The load elongates the strip. The extended length, $L_w$, of the original 2.5-cm mark with the weight in place) is measured and the total stretchability (elastic and inelastic), % S, in a given direction is calculated as a percentage of original length by the formula $\% S=100(L_w-2.5)/2.5$. Part of the total stretch is inelastic and part is elastic. The percent inelastic stretch, % IS, is measured by removing the weight from the sample and after two minutes measuring the new length, $L_o$, of the original 2.5-cm mark. The percent inelastic stretch is then calculated by the formula $\% IS=100 (L_o-2.5)/2.5$. Percent elastic stretch, % ES, is calculated by the formula $\% ES=100(Lw-Lo)/2.5$, or $\% ES=(\% S/-\% IS)$.

Latent contraction is measured on samples of the same size as used for the above-described stretch measurements. The samples are placed in a relaxed condition on a flat surface. The latent contraction is then activated by heating to 100° C. for 10 minutes and then allowed to cool to room temperature. The change in length from the standard length (i.e., 2.5 cm prior to activation) expressed as a percentage, is the % contraction, and is calculated by the formula $\% C=100(1-L_f/2.5)$. The amount that the sample can elastically stretch after the activation-induced contraction is measured as described above and is referred to as "latent elasticity".

EXAMPLES

The following examples further illustrate the invention with the manufacture of covers intended to fit at least two sizes of mattresses, a queen-size mattress and a king-size mattress. In each example, a fitted mattress cover was fabricated with an elastic top panel attached to a stretchable skirt. In each example, an elastic top panel of different construction was fabricated and attached to a stretchable skirt that had elastic yams incorporated under tension into its lower edge. Each cover satisfactorily fit a queen-size mattress that measured about 78-inches (1.9-m) long, 60-inches (1.52-m) wide and 9-inches (0.23-m) thick. Each cover also fit a king-size mattress that had about the same length and thickness as the queen-size mattress, but was about 25% wider.

Example 1

In this example a cover having with an elastic top panel is fabricated from a latently shrinkable quilted top panel.

A 1.3-oz/yd$^2$ (44 g/m$^2$) spunlace fabric of hydraulically polyester staple and wood-pulp fibers (i.e., SONTARA® Style 8801, manufactured by E. I. du Pont de Nemours & Co.) was overfed 4% to a two-bar stitchbonding machine. Each bar was 14 gauge (i.e., had 14 needles per 25 mm) and was set to insert 9 courses of stitches per inch (3.5/cm). Each bar was fully threaded with two yams per guide, each yam being a 70-denier (78-dtex) 40-filament textured nylon yarn. The front bar formed a series of 1-0, 0-1 chain stitches. The back bar formed a series of 1-0, 1-2 stitches.

A pad of polyester staple fibers having a unit weight of 5 oz/yd$^2$ (170 g/m$^2$) and a thickness of 0.5 inch (1.27 cm) was placed atop the stitchbonded fabric prepared according to the preceding paragraph. A 50-mesh plain-weave cotton fabric was then placed atop the polyester fiber pad. The thusly formed assembly of stitchbonded fabric, pad and cotton fabric was then quilt-stitched with 270-den (297-dtex) 34-filament textured polyester yams which formed about 10 stitches per inch (3.9/cm) in parallel lines of stitches, 2-inches (5.1-cm) apart. The parallel lines of quilt stitches were arranged perpendicular to the lines of stitches in the stitchbonded fabric. At this stage, the quilted top panel assembly was flat and inelastic.

A stretchable skirt fabric (XYMID® Style 4059 sold by Xymid LLC) that had elastic yarns incorporated into its 0.5-inch (1.3-cm) wide upper and lower edges was attached to the quilted top panel assembly. The skirt fabric was formed from a 0.7-oz/yd$^2$ (24-g/m$^2$) batt of hydraulically entangled 1.35-den (1.5-dtex) polyester staple fibers (i.e., SONTARA® Style 8034, manufactured by E. I. du Pont de Nemours & Co.) that was stitchbonded on a two-bar 14-gauge machine that inserted 11 courses per inch (4.3/cm) of 1-0, 1-2 stitches with textured 70-den (78-dtex) 34-filament textured polyester yam, fully threaded on the back bar and 1-0, 1-2, 1-2, 1-2 stitches with 70-den (78-dtex) LYCRA® spandex air-entangled with 40-den (44-dtex)-13-filament nylon yam fully threaded on the front bar. Elastic combination yams of spandex covered with textured nylon yam were incorporated into the upper and lower edges of the skirt fabric during the fabrication of the skirt fabric. Tension was applied to the upper elastic edge of the skirt to elongate the edge at least 50% and while so elongated, the edge was attached by sewing to the periphery of the quilted top panel assembly. At this stage of the fabrication, the skirted top panel remained inelastic.

The top panel with the attached skirt were then immersed in a relaxed condition in water at 85° C. and allowed to dry at room conditions. The top panel had become elastic in the direction perpendicular to the lines of quilting stitches and could stretch elastically at least 35% in that direction (YD in the drawing).

Example 2

A cover of the invention with an elastically stretchable top panel is formed as follows. A commercial LYCRA® spandex knit swimsuit fabric weighing 6 oz/yd$^2$ (204 g/m) and having an elastic stretch of at least 50% in the XD and YD directions was placed atop a 9-oz/yd$^2$ (306-g/m$^2$) cross-lapped web of 3-den (3.3-dtex) 3-inch (7.6 cm) long staple polyester fibers, and then quilt stitched to form parallel lines of stitches 2 inches (5.1 cm) apart. The thusly formed top panel was elastically stretchable (i.e., it fully recovered from the stretch) by 35% in a direction perpendicular to the lines of quilting stitches. A stretchable skirt of the same fabric as in Example 1 (i.e., XYMID® Style 4059) was attached by sewing to the periphery of the top panel. During the attachment of the skirt to the periphery of the top panel, the upper elastic edge of the skirt was stretched with at least 10% residual stretch and the top panel was fully stretched in the direction perpendicular to the lines of quilting stitches.

Example 3

The preceding example was repeated except that an additional fabric was placed on the face of the fiberfill polyester fiber pad opposite the spandex fabric. The second fabric was a 1.2-oz/yd$^2$ (41-g/m$^2$) SONTARA® Style 8010 spunlace fabric of 1.35-den (1.5-dtex) 0.78-inch (21-cm) long polyester staple fibers that were hydraulically entangled-on a 24 by 24 mesh screen. The top panel of the final cover was elastically stretchable by about 50% in the direction perpendicular to the quilting stitches.

Example 4

Example 2 was repeated with the following modifications. The lines of quilting stitches were replaced by "button stitching" which were separate circular groups of stitches located in a square grid pattern, each group of "button stitches" being 2-inches (5.1-cm) away from its closest neighboring stitch groups. The top panel was stretched about 40% in the XD and YD while the upper elastic edge of the skirt was stretched about 40% as it was attached by sewing to the periphery of the top panel. The final cover was readily stretchable elastically about 35% in both the XD and YD directions.

Example 5

Example 4 was repeated except that the top panel was attached to the elastic upper elastic edge of the skirt with the top panel in a relaxed (non-stretched) condition and the elastic upper edge of the skirt elongated to provide at least 50% residual stretch during the attachment. The resultant cover had a top panel that was stretchable elastically at least 35% in the XD and YD directions.

Example 6

In this example a cover having with an elastic top panel was fabricated from an elastically stretchable polyurethane foam layer laminated to a stitchbonded fabric.

A stitchbonded fabric of XYMID® Style 2041 (sold by Xymid LLC) was prepared as follows. A 1.2-oz/yd$^2$ (40.8-g/m$^2$) substantially nonbonded, spunbonded polyolefin sheet (TYVEK® Style 1424/T800 manufactured by E. I. du Pont de Nemours & Co.) was overfed 12% to a two-bar stitchbonding machine. Each bar was 14 gauge (i.e., had 14 needles per 25 mm) and was set to insert 14 courses of stitches per inch (5.5/cm). Each bar was fully threaded; the back bar with yam of 70-denier (78-dtex) LYCRA® spandex covered with 40-den (44-dtex) 13-filament nylon covered spandex and the front bar with yam of textured 70-den (78-dtex) 34-filament. The back bar formed a series of 0-1, 1-0 stitches and the front bar formed a series of 1-2, 1-0 stitches. The stitchbonded fabric was immersed in hot water in a relaxed condition. As a result of the treatment in hot water, the fabric contracted to about half its original length in the direction of the rows of stitches but did not contract at all in the direction perpendicular to the stitch rows.

The stitchbonded fabric of the preceding paragraph was then laminated with a discontinuous pattern of adhesive dots to a ⅜-inch (0.95-cm) thick pad of elastic polyurethane foam-to form a top panel. The top panel had an elastic stretch of about 35% in the direction of the lines of stitches in the stitchbonded fabric and 0% stretch in the direction transverse thereto.

The elastic upper edge of the same skirt fabric as was used in Example 1 was attached to the periphery of the top panel with full tension in the direction transverse to the direction or elastic stretch of the top panel and with the upper edge of the skirt under sufficiently low tension to assure at least 40% residual stretch in the edge.

We claim:

1. In a process for fabricating an elastic cover for objects of different cross-sectional dimensions, the process including the steps of forming a top panel, forming a stretchable skirt having an elastic upper edge in which are incorporated elastic yarns extending parallel to the periphery of the top panel and attaching the elastic upper edge of the stretchable skirt to the periphery of the top panel, the improvement comprising, forming the top panel with latent elastic contraction, attaching the upper edge of the skirt to the panel while the top panel is in a latently elastic condition and is held in a substantially non-tensioned condition and the upper edge of the skirt is held under sufficient tension to assure that the edge will contract enough to match the contraction of the top panel when the latent elastic contraction is activated, and activating the latent contraction after attaching the upper edge of the skirt to the top panel to form a cover that is elastically stretchable by at least 25% in at least one linear dimension.

2. The process of claim 1 in which the step of attaching the upper edge of the skirt to the panel comprises stretching the skirt parallel to the edge of the skirt from about 80–95% of full extension.

3. The process of claim 1 in which the top panel has a latent elastic contraction of at least 30% in one linear direction.

4. The process pf claim 3 in which the top panel has a latent elastic contraction of at least 50% in one linear direction.

5. The process of claim 1 in which the top panel has a latent elastic contraction in the range of 15 to 150% in two mutually perpendicular linear directions.

6. The process of claim 1 in which the skirt further comprises an elastic bottom edge that pulls a portion of the skirt against the sides, or underneath of the bottom, of an object to be covered.

7. The process of claim 1 in which the top panel comprises an elastic quilted composite fabric.

8. The process of claim 1 in which the object to be covered is a mattress.

* * * * *